US012642378B2

(12) United States Patent
Huerta

(10) Patent No.: US 12,642,378 B2
(45) Date of Patent: Jun. 2, 2026

(54) SIMULATED CAKE STRUCTURE FOR DISPLAYING FOOD AND BEVERAGES

(71) Applicant: Amber Huerta, Fountain, CO (US)

(72) Inventor: Amber Huerta, Fountain, CO (US)

( * ) Notice: Subject to any disclaimer, the term of this patent is extended or adjusted under 35 U.S.C. 154(b) by 0 days.

(21) Appl. No.: 18/904,954

(22) Filed: Oct. 2, 2024

(65) Prior Publication Data

US 2026/0090665 A1 Apr. 2, 2026

(51) Int. Cl.
*A47G 23/08* (2006.01)
*A47G 23/06* (2006.01)

(52) U.S. Cl.
CPC ..... *A47G 23/0641* (2013.01)

(58) Field of Classification Search
CPC ..... A47G 23/08; A47G 19/00; A47G 19/02; A47G 19/005; A47G 23/06; A47G 2019/005; A47G 2400/061; B65D 1/36; B65D 85/36; B65D 85/60; B65D 81/3216; B65D 2543/00361
USPC ..... 206/457, 527, 558, 216; 211/78
See application file for complete search history.

(56) References Cited

U.S. PATENT DOCUMENTS 2,281,849 A * 5/1942 Mccoppin ..... A47G 23/025 D7/600
D157,043 S 1/1950 Gruber
D160,688 S * 10/1950 Brock ..... 211/128.1
3,456,806 A * 7/1969 Borston ..... A45D 6/00 211/69.5
3,515,304 A * 6/1970 Beatrice ..... A47G 23/08 312/285
3,843,220 A 10/1974 Snider
4,461,790 A 7/1984 Snider
7,021,465 B1 4/2006 McGuigan
7,931,402 B1 4/2011 Oas
2006/0169618 A1 8/2006 Capes
2012/0234838 A1* 9/2012 Cheng ..... A47G 23/0241 220/575
2024/0017985 A1 1/2024 Neilson

FOREIGN PATENT DOCUMENTS

CA 976351 10/1975

* cited by examiner

*Primary Examiner* — King M Chu

(57) ABSTRACT

A food and beverage display apparatus for displaying and serving food and drinks in a tiered structure includes a holder assembly which has a base, a lid, and a plurality of sleeves. The base has a bottom wall and a perimeter wall, wherein the perimeter wall is coupled to and extends upwardly from the bottom wall. The base defines a recess which is surrounded by the bottom wall and the perimeter wall. The lid is removably positioned over the recess of the base. The sleeves are coupled to the lid and are arranged around a central vertical axis which extends through the lid. Each sleeve defines a channel therein for holding a food or beverage item.

16 Claims, 4 Drawing Sheets

SIMULATED CAKE STRUCTURE FOR DISPLAYING FOOD AND BEVERAGES

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to food serving dishes and more particularly pertains to a new food serving dish for displaying and serving food and drinks in a tiered structure.

(2) Description of Related Art Including Information Disclosed Under 37 CFR 1.97 and 1.98

Myriad serving dishes or other apparatuses are disclosed by the prior art which simulate an appearance of a cake while containing or supporting other food or beverage items. However, the prior art fails to describe such a serving apparatus in which beverage containers or food items may be held in radially arranged sleeves on various tiers which define interior spaces for holding ice to cool the beverage containers or food items.

BRIEF SUMMARY OF THE INVENTION

An embodiment of the disclosure meets the needs presented above by generally comprising a holder assembly which has a base, a lid, and a plurality of sleeves. The base has a bottom wall and a perimeter wall, wherein the perimeter wall is coupled to and extends upwardly from the bottom wall. The base defines a recess which is surrounded by the bottom wall and the perimeter wall. The lid is removably positioned over the recess of the base. The sleeves are coupled to the lid and are arranged around a central vertical axis which extends through the lid. Each sleeve defines a channel therein for holding a food or beverage item. Each sleeve further defines an opening which extends into the channel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
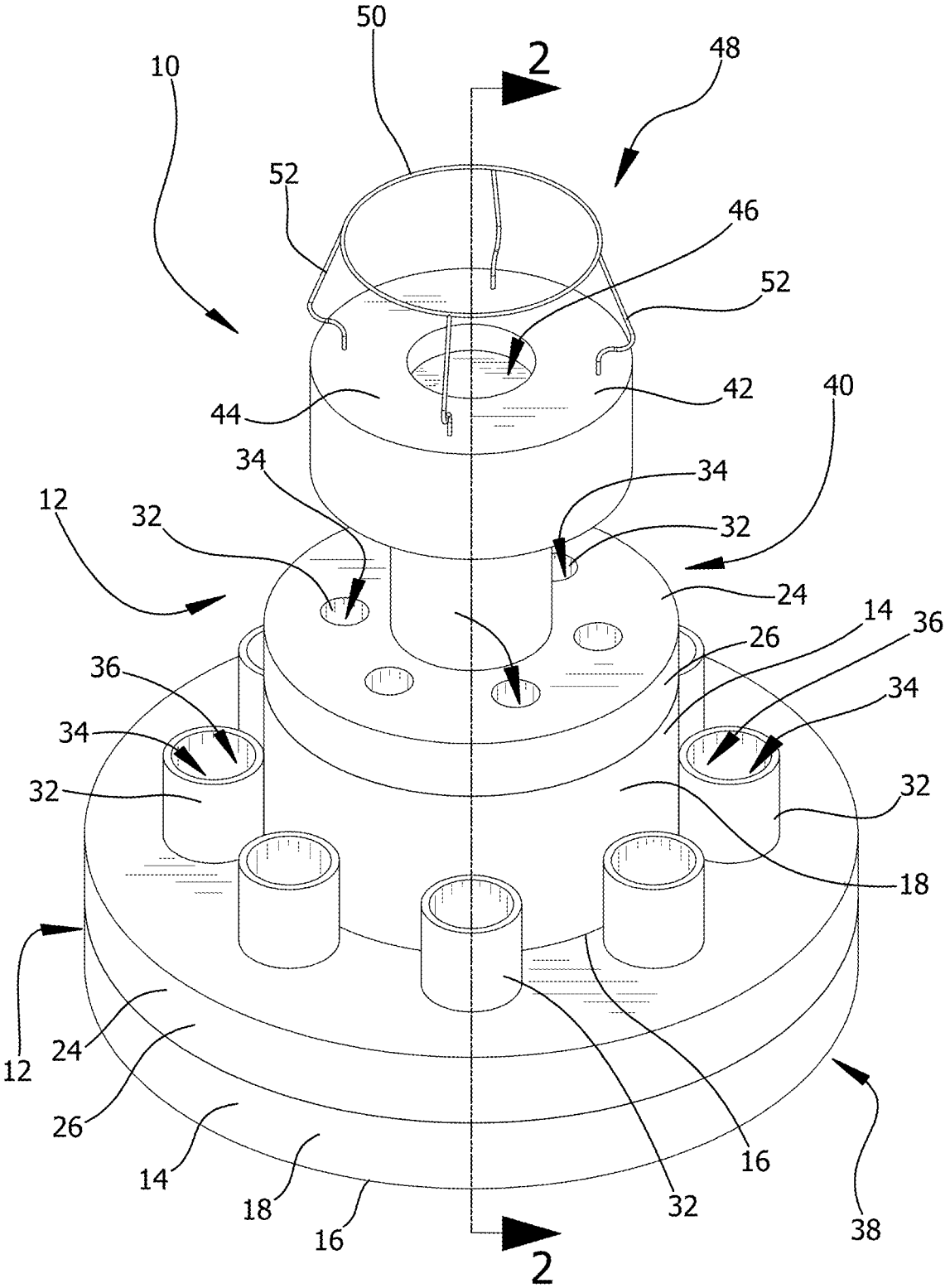
FIG. 1 is a perspective view of a food and beverage display apparatus according to an embodiment of the disclosure.
Figure 2:
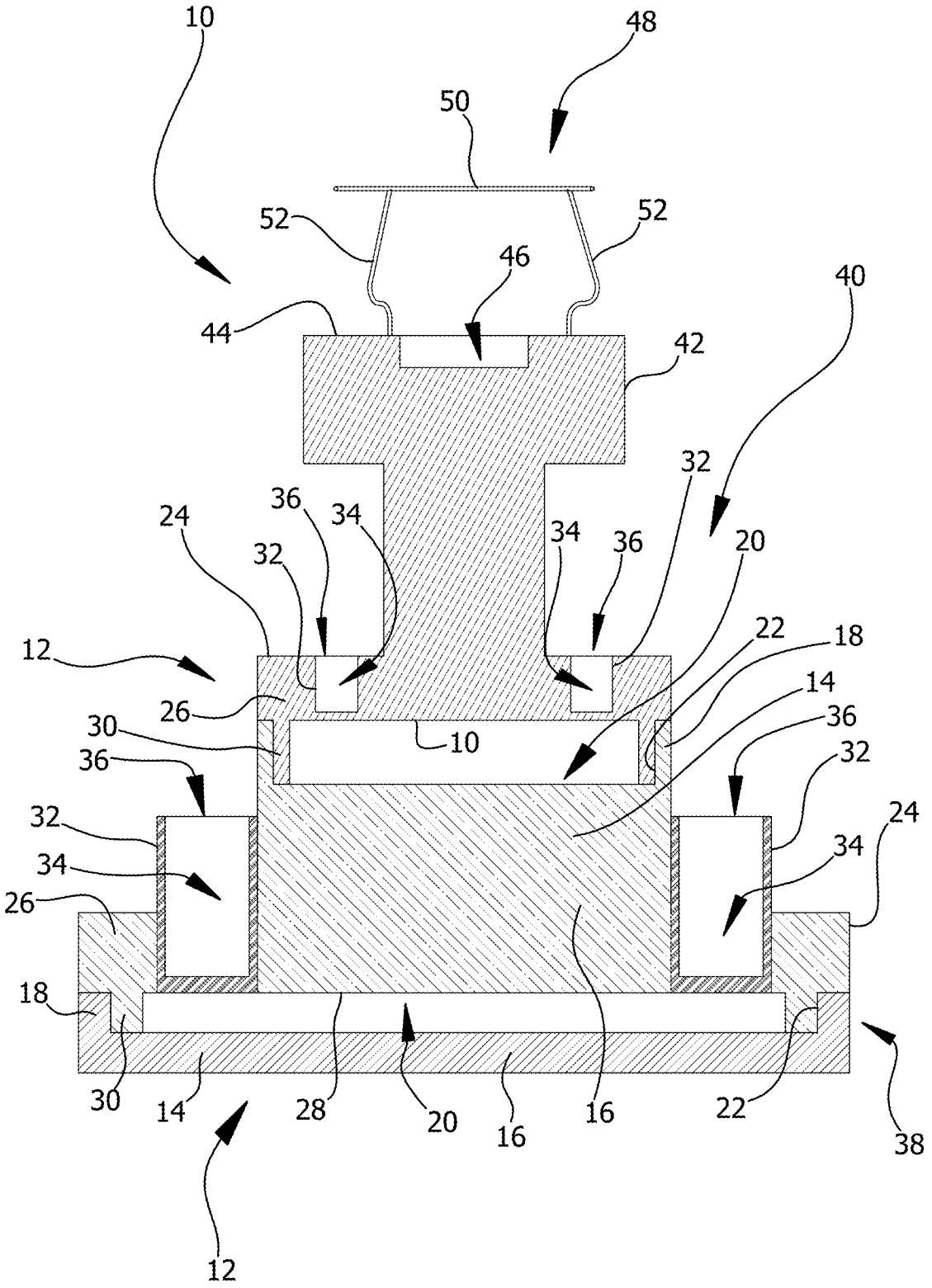
FIG. 2 is a cross-section view of an embodiment of the disclosure taken from Line 2-2 in FIG. 1.

With reference now to the drawings, and in particular to FIGS. 1 through 4 thereof, a new food serving dish embodying the principles and concepts of an embodiment of the disclosure and generally designated by the reference numeral 10 will be described.

As best illustrated in FIGS. 1 through 4, the food and beverage display apparatus 10 generally comprises a pair of holder assemblies 12 which are coupled to each other and arranged in a stack. Each holder assembly 12 comprises a base 14, a lid 24, and a plurality of sleeves 32. The base 14 has a bottom wall 16 and a perimeter wall 18, wherein the perimeter wall 18 is coupled to and extends upwardly from the bottom wall 16. The base 14 defines a recess 20 surrounded by the bottom wall 16 and the perimeter wall 18. The lid 24 is removably positioned over the recess 20 of the base 14 and forms a seal with the base 14 such that air or other gases are prevented or limited from moving between the recess 20 and an exterior atmosphere. The lid 24 comprises a main body 26 and a ring 30, wherein the ring 30 is coupled to and extends downwardly from the main body 26. The ring 30 is complementary in shape to an interior surface 22 of the perimeter wall 18 of the base 14 and abuts the bottom wall 16 of the base 14.

The sleeves 32 are coupled to the lid 24 and are arranged radially with respect to a central vertical axis which extends through the lid 24. Each sleeve 32 of the plurality of sleeves 32 defines a channel 34 therein for receiving an article such as a beverage container or a food item 72. Each sleeve 32 defines an opening 36 which extends into the channel 34. The opening 36 of each sleeve 32 faces upwardly with respect to the lid 24. The sleeves 32 extend through the lid 24 to a bottom side 28 of the main body 26 such that they are adjacent to the recess 20 when the lid 24 covers the base 14. The channel 34 of each sleeve 32 has a cylindrical shape but other suitable shapes may also be used in other embodiments, and those shapes may be adapted to accommodate beverage containers or foods of particular shapes.

The base 14 and the lid 24 comprise a thermally insulating material which limits heat transfer between the recess 20 of the base 14 and an exterior atmosphere. The thermally insulating material may be, for example, polystyrene foam, another foam, a vessel containing an evacuated or air-filled space, or the like. Ice or another thermal mass for regulating the temperature of the food or beverage contained in the sleeves 32 of a selected holder assembly 12 may be kept in the recess 20 of the base 14 of the selected holder assembly 12. The sleeves 32 may be formed of a separate material than the thermally insulating material such that the thermal mass may heat or cool the contents of the sleeves 32. In some embodiments, the sleeves 32 may be integrally formed with the lid 24 but form a divider of sufficient thickness to allow heating or cooling via the thermal mass. In some embodiments, the sleeves 32 may have a bottom aperture such that the contents of the sleeves 32 rest directly atop the thermal mass when contained in the sleeves 32.

The pair of holder assemblies 12 includes a lower holder assembly 38 and an upper holder assembly 40, wherein the base 14 of the upper holder assembly 40 is integrally formed with the lid 24 of the lower holder assembly 38. In other embodiments, the holder assemblies 12 may be removably coupled to each other or may be unconnected and placed in the stack. The upper holder assembly 40 is surrounded by the sleeves 32 of the lower holder assembly 38. In some embodiments, more than two holder assemblies 12 may be used. In such embodiments, the base 14 of each holder assembly 12, except for the bottommost holder assembly 12 of the stack, may be surrounded by the sleeves 32 of the successively lower holder assembly 38 in the stack. In this manner, the holder assemblies 12 are arranged in successively smaller tiers from the bottom of the stack to the top of the stack.

The width of the channel 34 of each sleeve 32 of the lower holder assembly 38 is greater than the width of the channel 34 of each sleeve 32 of the upper holder assembly 40. Each sleeve 32 of the lower holder assembly 38 may be sized and shaped to receive, for example, a can or a bottle of beer, soda, or other beverage. Each sleeve 32 of the upper holder assembly 40 may be sized and shaped to receive, for example, shot glasses. Other shapes and sizes may be accommodated by the sleeves 32 of each holder assembly 12 to match a desired use.

A top container 42 is integrally formed with the lid 24 of the upper holder assembly 40 and extends upwardly therefrom. The top container 42 defines a cavity 46 in a top surface 44 thereof which may be sized to receive a chafing fuel container 66. A dish support 48 is supported atop the top container 42, and a dish 54 is removably positionable on the dish support 48 and over the cavity 46 of the top container 42. The dish support 48 may removably rest atop the top container 42 or may be coupled to the top container 42.

The dish support 48 comprises a support ring 50 and a plurality of legs 52. The support ring 50 is spaced from the top surface 44 of the top container 42, and each leg 52 is coupled to the support ring 50. The legs 52 extend from the support ring 50 to the top container 42 to support the support ring 50 above the top container 42. The dish 54 has a lower wall 56 and a peripheral wall 58, wherein the peripheral wall 58 is coupled to and extends away from the lower wall 56. The dish 54 defines an interior space 60 surrounded by the lower wall 56 and the peripheral wall 58. An upper edge 62 of the peripheral wall 58 defines an opening 36 to the interior space 60. The dish 54 has a lip 64 which is coupled to and extends around the upper edge 62 of the perimeter wall 18. The lip 64 extends outwardly with respect to the peripheral wall 58 such that the dish 54 is positionable to rest the lip 64 against the support ring 50 of the dish support 48.

The overall shape of the food and beverage display apparatus generally tapers from a bottom end to a top end in tiers defined by each holder assembly 12 and the top container 42. The tiers thus simulate the tiers of a cake, and contents of the sleeves 32 may simulate candles or other decorations. Additional ornaments and indicia may be incorporated into the food and beverage display apparatus to further emphasize the similarities to a cake, such as molding or graphics which simulate icing, a greeting (e.g., "Happy Birthday"), and other decorations typically found on cakes.

Figure 3:
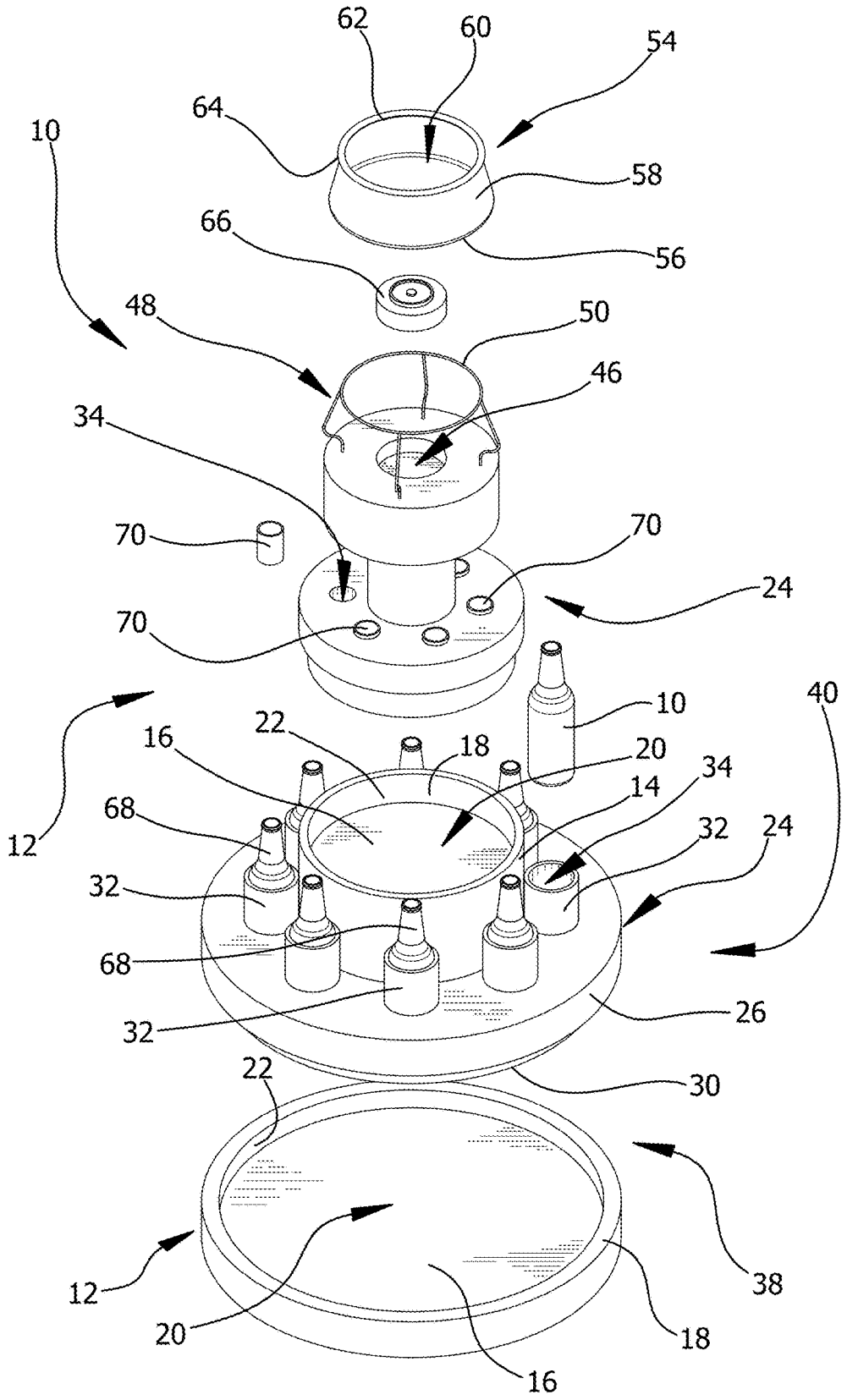
FIG. 3 is an exploded perspective view of an embodiment of the disclosure in use with a chafing fuel container, shot glasses, and beverage bottles.
Figure 4:
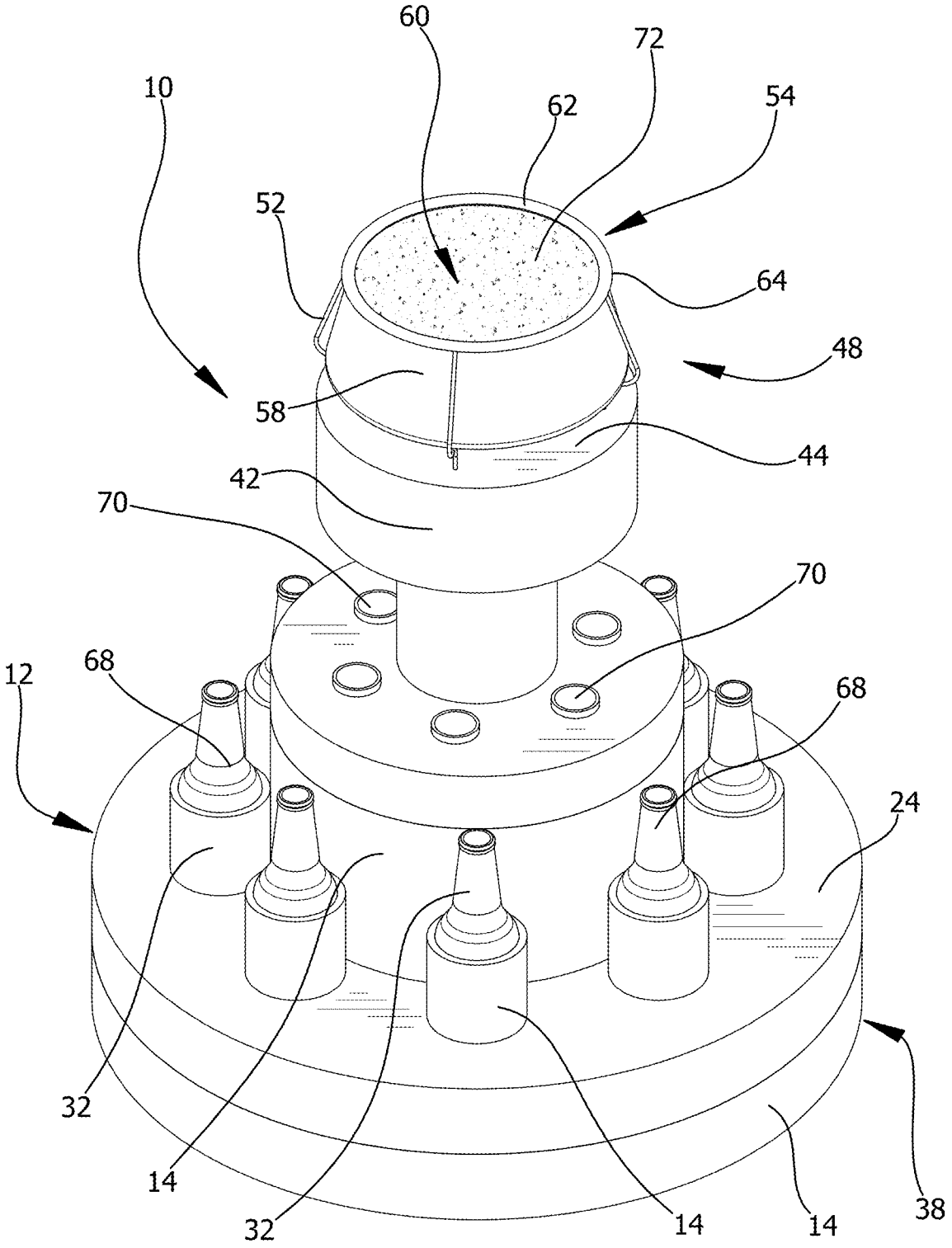
FIG. 4 is a perspective view of an embodiment of the disclosure in use with a food item, shot glasses, and beverage bottles.

In use, ice may be placed in the recesses 20 of the bases 14 of the holder assemblies 12, and beverage containers or other food or drink items may be placed in the sleeves 32 of the holder assemblies 12. The ice then acts to keep the beverage containers or other items cold. The chafing fuel container 66 may be placed in the cavity 46 of the top container 42, and the dish 54 may be placed on the dish support 48 over the chafing fuel container 66. Food may be contained in the dish 54 and heated by lighting the fuel from the chafing fuel container 66. The cavity 46 may also be used to contain food, a beverage container, or the like instead of the chafing fuel container 66. For example, FIGS. 3 and 4 depict beverage bottles 68 in the sleeves 32 of the lower holder assembly 38, shot glasses 70 in the sleeves 32 of the upper holder assembly 40, and a food item 72 being held in the dish 54.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A food and beverage display apparatus comprising:

a holder assembly comprising:

a base having a bottom wall and a perimeter wall, the perimeter wall being coupled to and extending upwardly from the bottom wall, the base defining a recess surrounded by the bottom wall and the perimeter wall;

a lid removably positioned over the recess of the base; and a plurality of sleeves coupled to the lid, the plurality of sleeves being arranged around a central vertical axis which extends through the lid, each sleeve of the plurality of sleeves defining a channel therein, each sleeve of the plurality of sleeves defining an opening which extends into the channel; and wherein the holder assembly is one of a pair of holder assemblies, the pair of holder assemblies being arranged in a stack, the pair of holder assemblies being coupled to each other, each holder assembly of the pair of holder assemblies comprising:

a base having a bottom wall and a perimeter wall, the perimeter wall being coupled to and extending upwardly from the bottom wall, the base defining a recess surrounded by the bottom wall and the perimeter wall;

a lid removably positioned over the recess of the base; and a plurality of sleeves coupled to the lid, the plurality of sleeves being arranged around a central vertical axis which extends through the lid, each sleeve of the plurality of sleeves defining a channel therein, each sleeve of the plurality of sleeves defining an opening which extends into the channel.

2. The food and beverage display apparatus of claim 1, wherein the lid of the holder assembly forms a seal with the base.

3. The food and beverage display apparatus of claim 1, wherein the lid comprises a main body and a ring, the ring being coupled to and extending downwardly from the main body, the ring being complementary in shape to an interior surface of the perimeter wall of the base, the ring abutting the bottom wall of the base.

4. The food and beverage display apparatus of claim 1, wherein the plurality of sleeves of the holder assembly are arranged radially around the central vertical axis.

5. The food and beverage display apparatus of claim 1, wherein the opening of each sleeve faces upwardly with respect to the lid.

6. The food and beverage display apparatus of claim 1, wherein the plurality of sleeves extends through the lid to a bottom side of the lid.

7. The food and beverage display apparatus of claim 1, wherein the channel of each sleeve has a cylindrical shape.

8. The food and beverage display apparatus of claim 1, wherein the base and the lid comprise a thermally insulating material which limits heat transfer between the recess of the base and an exterior atmosphere.

9. The food and beverage display apparatus of claim 1, wherein the pair of holder assemblies includes a lower holder assembly and an upper holder assembly, the base of the upper holder assembly being coupled to the lid of the lower holder assembly.

10. The food and beverage display apparatus of claim 9, wherein the upper holder assembly is surrounded by the sleeves of the lower holder assembly.

11. The food and beverage display apparatus of claim 9, wherein the width of the channel of each sleeve of the lower holder assembly is greater than the width of the channel of each sleeve of the upper holder assembly.

12. The food and beverage display apparatus of claim 1, further comprising a top container coupled to and extending upwardly from the pair of holder assemblies, the top container defining a cavity in a top surface thereof.

13. The food and beverage display apparatus of claim 12, wherein the top container is integrally formed with the lid of the upper holder assembly.

14. The food and beverage display apparatus of claim 12, further comprising:

a dish support supported atop the top container; and a dish removably positionable on the dish support and over the cavity of the top container.

15. The food and beverage display apparatus of claim 14, wherein:

the dish support comprises a support ring and a plurality of legs, the support ring being spaced from the top surface of the top container, each leg of the plurality of legs being coupled to the support ring and extending to the top container; and the dish having a lower wall and a peripheral wall, the peripheral wall being coupled to and extending away from the lower wall, the dish defining an interior space surrounded by the lower wall and the peripheral wall, an upper edge of the peripheral wall defining an opening to the interior space, the dish having a rim coupled to and extending around the upper edge of the perimeter wall, the lip extending outwardly with respect to the peripheral wall, the dish being positionable to rest the lip against the support ring of the dish support.

16. A food and beverage display apparatus comprising:

a pair of holder assemblies, the pair of holder assemblies being arranged in a stack, the pair of holder assemblies being coupled to each other, each holder assembly of the pair of holder assemblies comprising:

a base having a bottom wall and a perimeter wall, the perimeter wall being coupled to and extending upwardly from the bottom wall, the base defining a recess surrounded by the bottom wall and the perimeter wall;

a lid removably positioned over the recess of the base, the lid forming a seal with the base, the lid comprising a main body and a ring, the ring being coupled to and extending downwardly from the main body, the ring being complementary in shape to an interior surface of the perimeter wall of the base, the ring abutting the bottom wall of the base; and a plurality of sleeves coupled to the lid, the plurality of sleeves being arranged radially with respect to a central vertical axis which extends through the lid, each sleeve of the plurality of sleeves defining a channel therein, each sleeve of the plurality of sleeves defining an opening which extends into the channel, the opening of each sleeve facing upwardly with respect to the lid, the plurality of sleeves extending through the lid to a bottom side of the lid, the channel of each sleeve having a cylindrical shape;

wherein the base and the lid comprise a thermally insulating material which limits heat transfer between the recess of the base and an exterior atmosphere;

wherein the pair of holder assemblies includes a lower holder assembly and an upper holder assembly, the base of the upper holder assembly being integrally formed with the lid of the lower holder assembly, the upper holder assembly being surrounded by the sleeves of the lower holder assembly, the width of the channel of each sleeve of the lower holder assembly being greater than the width of the channel of each sleeve of the upper holder assembly;

a top container coupled to and extending upwardly from the pair of holder assemblies, the top container defining a cavity in a top surface thereof, the top container being integrally formed with the lid of the upper holder assembly;

a dish support supported atop the top container, the dish support comprising a support ring and a plurality of legs, the support ring being spaced from the top surface of the top container, each leg of the plurality of legs being coupled to the support ring and extending to the top container; and a dish removably positionable on the dish support and over the cavity of the top container, the dish having a lower wall and a peripheral wall, the peripheral wall being coupled to and extending away from the lower wall, the dish defining an interior space surrounded by the lower wall and the peripheral wall, an upper edge of the peripheral wall defining an opening to the interior space, the dish having a rim coupled to and extending around the upper edge of the perimeter wall, the lip extending outwardly with respect to the peripheral wall, the dish being positionable to rest the lip against the support ring of the dish support.

* * * * *